United States Patent [19]

Ledebrink

[11] Patent Number: 4,702,862

[45] Date of Patent: Oct. 27, 1987

[54] METHOD FOR THE FINAL CONDITIONING OF RADIOACTIVE AND/OR TOXIC WASTE

[75] Inventor: Friedrich-Wilhelm Ledebrink, Maintal, Fed. Rep. of Germany

[73] Assignee: Alkem GmbH, Hanau, Fed. Rep. of Germany

[21] Appl. No.: 436,302

[22] Filed: Oct. 25, 1982

[30] Foreign Application Priority Data

Oct. 26, 1981 [DE] Fed. Rep. of Germany ..... 3142356

[51] Int. Cl.[4] ..... G21F 9/16

[52] U.S. Cl. ..... 252/628; 252/633

[58] Field of Search ..... 252/628, 626, 633, 631; 264/0.5, 56, 60, 65; 250/506.1, 507.1; 405/128–129; 376/261, 272

[56] References Cited

U.S. PATENT DOCUMENTS

| | | | |
|---|---|---|---|
| 4,058,479 | 11/1977 | White | 250/506.1 |
| 4,148,745 | 4/1979 | Rudolph | 252/628 |
| 4,204,974 | 5/1980 | Puthawala et al. | 252/628 |
| 4,230,597 | 10/1980 | Bustard et al. | 252/633 |
| 4,242,220 | 12/1980 | Sato | 34/4 |
| 4,280,922 | 7/1981 | Puthawala | 264/0.5 |
| 4,293,438 | 10/1981 | Ledebrink | 159/DIG. 12 |
| 4,350,620 | 9/1982 | Hartinger et al. | 252/628 |
| 4,431,164 | 2/1984 | Jungo | 252/628 |

FOREIGN PATENT DOCUMENTS

| | | | |
|---|---|---|---|
| 2631326 | 1/1978 | Fed. Rep. of Germany | 252/628 |
| 2741661 | 3/1979 | Fed. Rep. of Germany | 252/628 |
| 2819086 | 10/1979 | Fed. Rep. of Germany | 252/628 |
| 3018748 | 11/1981 | Fed. Rep. of Germany | 252/628 |
| 2473213 | 7/1981 | France | 252/628 |
| 0030400 | 3/1979 | Japan | 252/628 |

*Primary Examiner*—John F. Terapane
*Assistant Examiner*—Howard J. Locker
*Attorney, Agent, or Firm*—Herbert L. Lerner; Laurence A. Greenberg

[57] ABSTRACT

Method for the final conditioning of radioactive and/or toxic waste by fusing it into thermoplastic matrix material, binding radioactive and/or toxic pollutants contained in the waste from all sides, characterized by the feature that radioactive thermoplastic synthetic material is used as the thermoplastic matrix material.

4 Claims, No Drawings

METHOD FOR THE FINAL CONDITIONING OF RADIOACTIVE AND/OR TOXIC WASTE

BACKGROUND OF THE INVENTION

1. Field of the Invention

The invention relates to a method for the final conditioning of radioactive and/or toxic waste by fusing it into thermoplastic matrix material, thereby enclosing radioactive and/or toxic pollutants contained in the waste.

2. Description of the Prior Art

Such a method is already in use. There, weakly or medium-active waste, for instance, radioactive ion exchangers, radioactive calcinates, radioactive tributyl phosphate etc. is fused into thermoplastic matrix material, which may be non-radioactive polyvinylchloride or polyethylene. This non-radioactive polyvinylchloride or polyethylene is obtained in the form of granulate and is mixed with the radioactive waste. The waste is fused by passing the mixture through a heated extruder, at the exit end of which the polyvinylchloride or polyethylene leaves in flowable form and is cast into compact plastic blocks suitable for final storage.

For economic reasons the volume of the radioactive waste to be stored is required to be kept as small as possible.

SUMMARY OF THE INVENTION

An object of the invention is to improve the known method further in the direction of minimizing the volume of radioactive waste to be stored.

With the foregoing and other objects in view, there is provided in accordance with the invention a method for the final conditioning of radioactive and/or toxic waste by fusing it into thermoplastic matrix material, binding radioactive and/or toxic pollutants contained in the waste from all sides, the improvement comprising using radioactive thermoplastic synthetic material as the thermoplastic matrix material.

Other features which are considered as characteristic for the invention are set forth in the appended claims.

Although the invention is illustrated and described herein as embodied in a method for the final conditioning of radioactive and/or toxic waste, it is nevertheless not intended to be limited to the details shown, since various modifications may be made therein without departing from the spirit of the invention and within the scope and range of equivalents of the claims.

The invention, however, together with additional objects and advantages thereof will be best understood from the following description.

DETAILED DESCRIPTION OF THE INVENTION

In accordance with the invention, a method of the kind mentioned at the outset is characterized by the feature that radioactive thermoplastic synthetic material is used as the thermoplastic matrix material.

This radioactive thermoplastic synthetic material may itself be active waste. Although using it as the matrix material increases the specific radioactivity of the obtained synthetic material blocks to be finally stored, this can be done within permissible limits, such that no additional measures need be taken in the final storage of the synthetic-material blocks obtained.

On the other hand, however, an increased amount of radioactive waste can be taken up by the volume occupied by a plastic block. It is known to burn radioactive waste to reduce the volume, and to bind the ash, for instance in concrete, and to store it. However, this method cannot be used if the radioactive waste contains radioactive halogen-containing plastic such as polyvinylchloride, since hydrochloric-acid gas would be produced in burning such a plastic. This acid gas would have to be neutralized and would result as a neutralization product in the form of a radioactive salt solution which in turn would have to be converted into a solid product capable of final storage.

It is advantageous to melt the waste in an electromagnetic high-frequency field to radioactive thermoplastic synthetic material. Thereby, the halogen-containing plastic in the radioactive waste is heated uniformly, so that the formation of hydrochloric acid gas by local overheating of the plastic waste mixture is prevented. A typical heterogeneous radioactive waste mixture produced in the manufacture of plutonium-containing nuclear reactor fuel assemblies may contain the following organic components, in addition to inorganic components:

70% by weight radioactive polyvinylchloride, 15% by weight radioactive sythetic rubber, 10% by weight radioactive cellulose, and 5% by weight various other radioactive synthetic materials.

These radioactive organic waste components are comminuted in an impeller breaker to an average grain size of 5 mm. The comminuted radioactive organic waste components are then optionally mixed with inorganic radioactive waste components, for instance, small metal scrap or broken glass and the mixture is filled into a container of polytetrafluoroethylene. After closing the container with a lid which also consists of polytetrafluoroethylene, the container is arranged in an electromagnetic high-frequency field, and the polyvinylchloride contained in the container is heated to a temperature of 150° C. Thereby, not only the radioactive polyvinylchloride in the container, but also the other radioactive thermoplastic synthetic materials are made to flow. These radioactive thermoplastic synthetic materials which have been made to flow become effective as matrix material. They enclose from all sides the waste components that have remained solid, and all the radioactive substances contained in the waste. After the electromagnetic high-frequency field has been turned off, the matter contained in the container of polytetrafluoroethylene solidifies to a void-less radioactive synthetic material block which is placed, together with the polytetrafluoroethylene container, in a barrel of alloy steel, which is capable of final storage after being closed with an alloy steel lid.

Advantageously, a substance which binds HC1 without gas development is added to the radioactive plastic in the radioactive waste mixture prior to the heating in the electromagnetic high-frequency field and thus, prior to the fusing. Especially well suited as such a substance is calcium oxide in powder form which is uniformly admixed to the waste in an amount of less than 1% by weight based on the radioactive halogen-containing plastic content of this waste.

It is further of advantage, for better utilizatin of the capaciaty of the container of polytetrafluoroethylene, to fill and fuse into this container radioactive waste mixture repeatedly one after the other. It is of advantage here to pre-densify the respectively filled-in mixture by means of a compacting tool and to thereby reduce the number of fusing processes.

It is also advantageous to perform the constraining of the radioactive waste mixture in the container of polytetrafluoroethylene in an atmosphere above the waste mixture in the container, which has a working pressure of less than 1 bar. Thereby, the formation of voids in the radioactive plastic block by gas bubbles in the thermoplastic phase is more effectively prevented. This working pressure can be produced by means of a suction pump which is connected to a suction nozzle of the lid of the container of polytetrafluoroethylene.

With this method for the final conditioning, a density of the organic component of the radioactive waste to be finally stored can be obtained which is nearly the same as the theoretical density of 1.4 g/cm$^3$ of polyvinylchloride and which means a densification by a factor of 3 to 5 over the organic component of the waste mixture prior to the fusion.

The foregoing is a description corresponding to German Application No. P 31 42 356.6, dated Oct. 26, 1981, international priority of which is being claimed for the instant application, and which is hereby made part of this application. Any discrepancies between the foregoing specification and the aforementioned corresponding German application are to be resolved in favor of the latter.

We claim:

1. A method for the final conditioning of radioactive and/or toxic waste which comprises mixing said waste with a radioactive thermoplastic synthetic waste material with a greater than naturally occurring level of radioactivity, said mixture of waste and radioactive thermoplastic synthetic waste material containing radioactive, chlorine-containing thermoplastic synthetic waste material, heating the mixture of said waste and said thermoplastic waste material to a temperataure sufficient to make the thermoplastic waste material flow and become effective as a matrix material enclosing from all sides radioactive waste components of said waste that have remained solid, prior to said heating admixing a substance which binds HC1 without gas development to the radioactive thermoplastic synthetic waste material to prevent release of HCl gas resulting from the decomposition of the chlorine-containing thermoplastic waste material during said heating, and cooling the thermoplastic waste material having embedded therein the solid radioactive waste components of said waste material to solidfy it.

2. Method according to claim 1, wherein the radioactive chlorine-containing thermoplastic synthetic waste material is radioactive polyvinylchloride.

3. A method for the final conditioning of radioactive and/or toxic waste which comprises mixing said waste with a radioactive thermoplastic synthetic waste material with a greater than naturally occurring level of radioactivity, said mixture of waste and radioactive thermoplastic synthetic waste material containing radioactive, halogen-containing thermoplastic synthetic waste material, placing the mixture of said waste and said thermoplastic waste material in a polytetrafluoroethylene container, closing said container, thereafter heating the mixture of said waste and said thermoplastic waste material uniformly in the closed container in an electromagnetic high-frequency field to avoid local overheating of the mixture and minimize decompositin of the halogen-containing thermoplastic material with accompanying liberation of a halogen-containing gas to a temperature sufficient to make the thermoplastic waste material flow and become effective as matrix material enclosing from all sides radioactive waste components of said waste that have remained solid, maintaining an atmosphere in the container during heating of less than 1 bar by applying suction through an opening in the container to minimize formation of voids by gas bubbles in radioactive thermoplastic material in the container, cooling the thermoplastic waste material having embedded therein the solid radioactive waste components of said waste material to solidify it, placing the container together with its contents in a barrel of alloy steel, closing said barrel and subsequently sending said closed barrel to ultimate storage.

4. Method according to claim 3, wherein the radioactive thermoplastic synthetic waste material is radioactive polyvinylchloride.

* * * * *